United States Patent [19]

Hartbauer et al.

[11] 3,960,272

[45] June 1, 1976

[54] ROLL PRODUCT WITH MANUALLY GRASPABLE TAIL END AND MANUFACTURE THEREOF

[75] Inventors: Ellsworth A. Hartbauer, Concord; Henry W. Rehr, Clayton, both of Calif.

[73] Assignee: Crown Zellerbach Corporation, San Francisco, Calif.

[22] Filed: May 5, 1975

[21] Appl. No.: 574,843

Related U.S. Application Data

[62] Division of Ser. No. 476,017, June 3, 1974.

[52] U.S. Cl. ..... 206/389; 156/184

[51] Int. Cl.[2] ..... B65D 85/67

[58] Field of Search ..... 206/389, 411, 394, 813; 229/85, 51 TS; 225/90; 156/184, 187

[56] References Cited

UNITED STATES PATENTS

| | | | |
|---|---|---|---|
| 1,949,259 | 2/1934 | Salsman | 206/389 |
| 2,015,268 | 9/1935 | Hammond | 206/411 |
| 3,172,612 | 3/1965 | Besserdich | 156/184 |
| 3,470,052 | 9/1969 | Herman | 156/184 |
| 3,532,573 | 10/1970 | Herman | 156/184 |
| 3,592,340 | 7/1971 | Hoey | 206/389 |
| 3,733,025 | 5/1973 | Hiersteiner | 229/85 |

FOREIGN PATENTS OR APPLICATIONS

| | | | |
|---|---|---|---|
| 659,615 | 10/1951 | United Kingdom | 206/411 |

*Primary Examiner*—William T. Dixson, Jr.
*Attorney, Agent, or Firm*—Thomas R. Lampe; Corwin R. Horton

[57] ABSTRACT

Method of and apparatus for securing the unaffixed tail portion of a roll product to a convolution thereof underlying said tail portion wherein the completed roll product is provided with a manually graspable fold on the tail portion which is releasably secured to the underlying roll product convolution as by means of adhesive. Apparatus structure and method steps are provided whereby the tail portion of the roll product is positioned so that the free end thereof is spaced from a wound portion of the roll product. A fold is then provided in the roll product tail portion and a quantity of adhesive is applied to the roll product at a predetermined location thereon. The tail portion is then wound about the roll product wound portion and the fold is secured to the roll product convolution underlying same with said adhesive. A completed roll product is thus formed comprising an elongated sheet of flexible material wound to provide a plurality of convolutions including the outer tail portion convolution. The fold formed in the tail portion comprises a plurality of tail portion segments disposed in substantially parallel relationship with one of the segments terminating with a free end. The fold is in abutting engagement with an underlying convolution of the sheet material and releasably secured thereto. The releasably secured fold is adapted for manual grasping by the user of the roll product whereby release of the secured fold and unwinding of the roll product are facilitated.

21 Claims, 22 Drawing Figures

ROLL PRODUCT WITH MANUALLY GRASPABLE TAIL END AND MANUFACTURE THEREOF

This is a division of application Ser. No. 476,017, filed June 3, 1974.

BACKGROUND OF THE INVENTION

The present invention relates to an improved roll product and an improved method and apparatus utilized in the manufacture of such roll product. A number of arrangements are disclosed in the prior art whereby the tail portion or outer terminal convolution of a roll product such product such as paper toweling, toilet tissue, and the like, is secured to the underlying convolution thereof. In particular, attention is directed to U.S. Pat. No. 3,393,105 which issued July 16, 1968 to Clair W. Tellier, Jr. and to copending U.S. application Ser. No. 194,159, filed Nov. 1, 1971 in the name of Ellsworth A. Hartbauer et al.

As explained in the aforementioned U.S. Pat. No. 3,393,105, in paper converting operations it is common practice to rewind from a large parent or supply roll a plurality of elongated cants which are then severed into individual rolls. One of the many problem areas arising during converting is that of securing the tail portion or outer terminal convolution of the cant to the underlying or contiguously subjacent convolution prior to the cant being advanced into the severing and wrapping machinery in which the relatively long cant (or log, as it is sometimes called) is segmented into a plurality of small rolls which are then wrapped for shipment and sale. If the tail of the cant is not secured to the underlying convolution, the severing and wrapping unsightly may not be properly performed, in which event the wrapping machinery may jam or, if the wrap is successfully performed, excess paper from the completed roll product may extend from the wrapper, thereby resulting in an package.

The aforementioned U.S. Pat. No. 3,393,105 and the aforementioned copending application U.S. Ser. No. 194,159 both disclose arrangements for adhesively securing the tail portion of a cant to the immediately underlying convolution, thereby obviating the prior requirement for the presence of personnel whose function it is to manually secure the free tail of the cant prior to delivery thereof into the servering and wrapping machinery. In U.S. Pat. No. 3,393,105 the adhesive securing operation is carried out by rotating the roll product cant in a direction tending to wind the tail portion thereabout, unwinding the tail portion therefrom, depositing a predetermined quantity of adhesive directly onto the tail portion while the tail porting is unwound therefrom at a pre-established location adapted to underlie the rewound tail portion, and rewinding the tail portion about the roll product so that the tail portion overlies the adhesive which thereby secures the tail portion to the convolution underlying same.

The arrangement disclosed in copending application Ser. No. 194,159 differs from that disclosed in the Tellier patent in a number of significant respects, although the end objective of adhesively securing the tail portion of a roll product to the underlying convolution thereof is the same. In the application, while the tail portion is unwound from the rest of the roll, adhesive is applied to the roll product convolution normally underlying same in the form of discrete dots of adhesive which are ejected through a plurality of nozzles spaced along the length of the roll product cant. This arrangement provides a number of advantages over that disclosed in the Tellier patent. Since the advantages are clearly set forth in the specification of the aforementioned application, they will not be gone into here.

Although the apparatus and methods disclosed in the aforementioned patent and application are in general quite satisfactory, there are certain characteristics of the completed roll product produced thereby that could be advantageously improved upon. In particular, the single ply or multi-ply roll products produced by the apparatus and methods of the aforementioned patent and application have a common characteristic; that is, the tail portion thereof lies in abutting engagement with the underlying convolution as a single layer of the single or multi-ply material of which it is comprised. While the roll products produced according to the teachings of the aforementioned patent and application offer significant advantages over prior art roll products insofar as easy-opening characteristics are concerned, some difficulties are still encountered on occasion by the purchaser insofar as starting or opening of the final roll product featuring the adhesively secured tail portions is concerned. In other words, the roll products produced according to the teachings of the aforementioned patent and application share some of the defects, although to a lesser extent, of conventional prior art roll products insofar as opening characteristics are concerned. Such undesirable opening characteristics include lack of a readily graspable element to the start the roll, inadequate material strength at the location of manual grasping such that elongated tears or rips in the roll product material are inadvertently made by the customer, inadvertent separation of plies upon opening of the roll in the case of multi-ply roll product materials, and an overall package appearance that features a somewhat ragged tail portion free end.

SUMMARY OF THE INVENTION

The aforementioned deficiencies are obviated according to the teachings of the present invention wherein a structurally simple but reliable apparatus and a method are provided for the manufacture of a roll product incorporating a manually graspable element in the form of a fold in the tail portion of the roll product that is releasably secured to an underlying convolution of the roll product as by means of adhesive. According to the invention means is provided for positioning the tail portion of the roll product so that the free end of the tail portion is spaced from a wound portion of the roll product. Further, means is provided for forming a fold in the tail portion after positioning thereof by the positioning means. Applicator means is then utilized to apply adhesive onto the roll product at a predetermined location thereon after positioning of the tail portion and means is provided for rotating the roll product to wind the tail portion onto the wound portion after formation of the fold whereby the fold is brought into engagement with an underlying roll product convolution and said adhesive is disposed therebetween.

The roll product manufactured on apparatus according to the present invention and by means of the steps of the method of the present invention comprises an elongated sheet of flexible material wound to provide a plurality of convolutions and having a tail portion. A fold is formed in the tail portion, said fold comprising a plurality of tail portion segments disposed in substantially parallel relationship with one of said segments terminating with a free end, and said fold being in abutting engagement with an underlying convolution of said sheet material. Securing means is provided to releasably secure the fold to the underlying convolution and the fold thus secured is adapted for manual grasping by the user of the roll product whereby release of the secured fold and unwinding of the roll product are facilitated.

BRIEF DESCRIPTION OF THE DRAWINGS

Additional advantages, characteristics and objects of the present invention, including those of particularized character, will become apparent hereinafter as the specification continues and with reference to the accompanying drawings in which.

GENERAL DESCRIPTION

Figure 1:
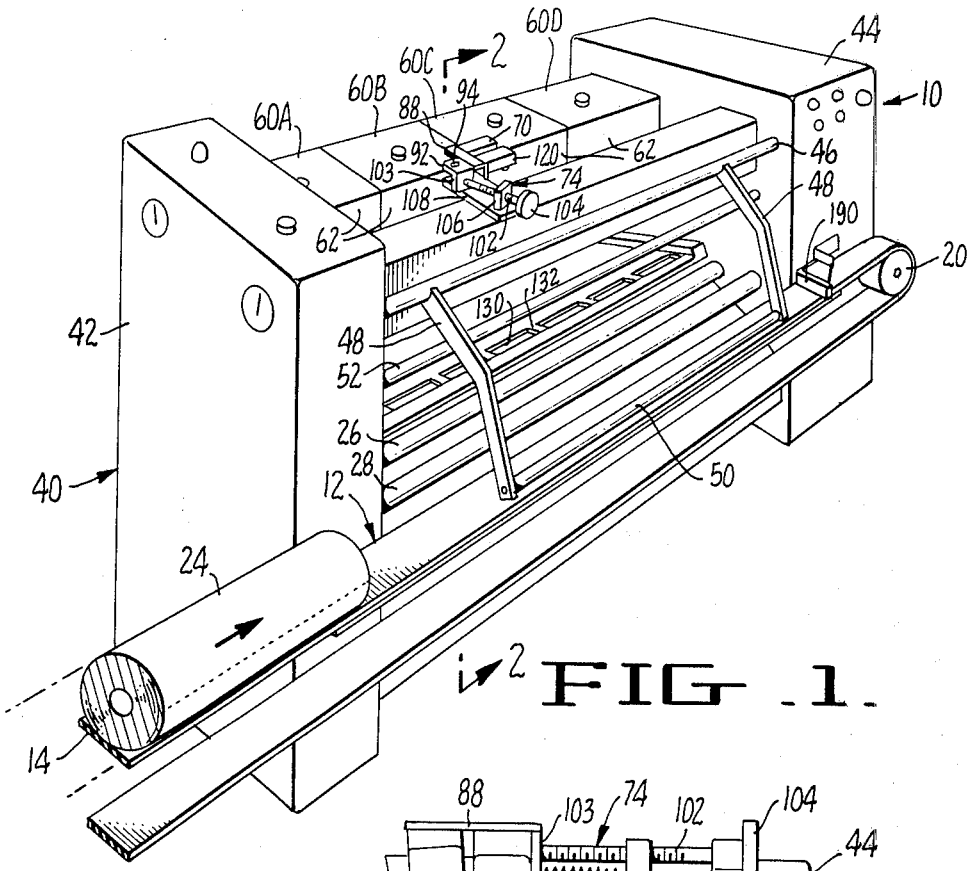
FIG. 1 is a perspective view of apparatus embodying the present invention.

Referring now to FIG. 1 of the drawings, apparatus 10 constructed in accordance with the teachings of the present invention is illustrated. Apparatus 10 includes an infeed conveyor generally designated with the numeral 12 which is adapted to position the cants or logs of roll product into operative position relative to the apparatus 10. For purposes of illustration, operation of the apparatus 10 will be described with the roll product comprising a paper tissue material, such as that utilized in the manufacture of individual rolls of toilet tissue. The infeed conveyor utilized in apparatus 10 may be completely conventional, and as shown in FIG. 1 it includes an endless belt 14 with suitable stationary side rails (not shown) being employed to prevent the cants while being conveyed by the belt from rolling therefrom. The endless belt 14 is entrained about the usual drive and idler rollers, such as the idler roller 20. A support pad or platform 22 (FIG. 2) may be disposed along the under surface of the forwardly advancing top leg or reach of the belt to cooperate therewith in supporting the weight of each cant being conveyed thereby.

In FIG. 1 a portion of a roll product in the form of a cant 24 is illustrated as being conveyed by endless belt 14 into operative association with apparatus 10. The roll product cant 24 may be wound from a web of any suitable flexible material as, for example, cloth of either natural or synthetic fibers, plastic material, metallic foils, and paper — either single ply or multi-ply. For illustration purposes, the roll product 24 will be a cant of toilet tissue which will be cut into conventional toilet tissue roll lengths and then enclosed in appropriate wrappers after the tail portion of the cant has been secured to the convolution underlying same. The roll product or cant 24 may be of any suitable length and the apparatus is designed to accommodate predetermined maximum lengths. With specific reference to a cant of toilet tissue, the length thereof depends upon the characteristics of the rewinding machinery and there is no particular standard in the paper industry. However, typical lengths are 55 inches, 66 inches, 90 inches and 92 inches.

Figure 2:
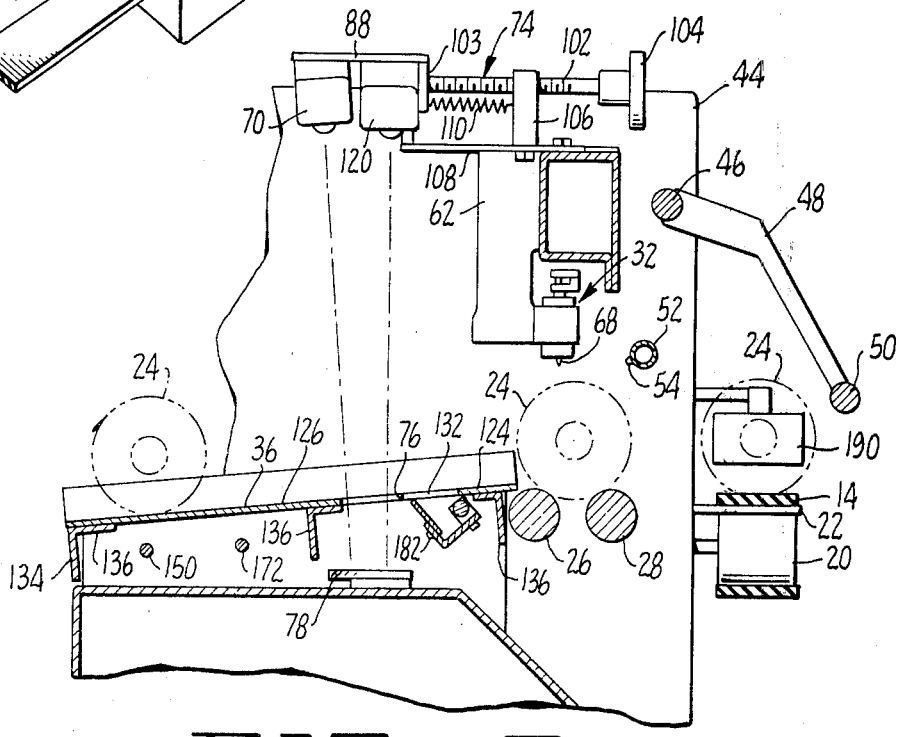
FIG. 2 is a broken transverse sectional view along the line 2—2 of FIG. 1.
Figure 3:
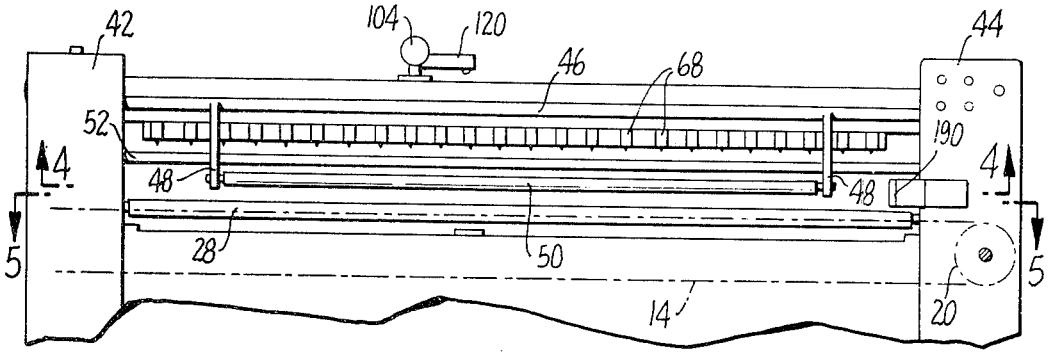
FIG. 3 is a broken frontal elevational view showing a portion of the infeed side of the apparatus of FIG. 1.

Apparatus 10 includes a single operating station at which the roll product cant 24 is located during the time that al of the various functions are performed thereon that consummate in a fold formed in the tail portion of the cant being secured to the immediately subjacent convolution. Such station is illustrated in FIGS. 10A through 10H, and it is defined at its lowermost extremity by a pair of longitudinally extending, transversely spaced and substantally parallel rollers or shafts 26 and 28 that are continuously rotating in a clockwise direction, as viewed in these figures, and receive and support the cant 24 thereon. It will be helpful at this point to describe a general functional sequence wherein the desired operations to the roll product or cant 24 take place. The cant 24 is displaced from the belt 14 of the infeed conveyor into the operating station upon the shafts 26 and 28 so as to be rotated thereby in a counterclockwise direction. As the cant 24 is rotated, the tail or free end portion 30 thereof is unwrapped therefrom, and an adhesive is applied to the cant at an adhesive station generally denoted by means of reference numeral 32. Also as the cant is rotated, a fold is provided in the tail or free end portion 30 as it is being rewound about the cant. The fold is formed at the extreme free end of the tail portion at a tail forming station denoted generally by means of reference numeral 34. Due to the continued rotation of the cant by rollers 26 and 28, the tail portion is wrapped about the cant and the fold formed therein is adhesively secured to the underlying convolution onto which the adhesive was applied. The cant 24 is thereafter displaced laterally from the operating station to a discharge mechanism, including in the particular apparatus shown, an inclined chute or platform 36. In FIG. 2, a cant is illustrated in phantom in three consecutive positions it assumes during operation of apparatus 10. The toilet tissue cant is then delivered to cutting or severing apparatus (not shown) which operates to subdivide the relatively long cants into individual rolls which are delivered to wrapping mechanism (not shown) which serves to package the individual rolls within a cellophane or other wrapper. The severing apparatus and the wrapping apparatus may be completely conventional and do not comprise a part of the present invention.

Having thus described generally the sequence of operations which results in a tail portion fold being releasably secured to an underlying convolution of the roll product by means of adhesive, apparatus 10 and its function will now be described in greater detail.

Returning once again to FIG. 1, the tail securing apparatus 10 includes frame structure of standard and appropriate character generally indicated in its entirety by the reference numeral 40. It will be understood that such frame structure comprises the usual channels, brackets, end walls and similar elements; and since arrangements of this type are old and very well-known, the frame structure will not be described in detail and the various elements thereof will simply be considered to be a part of the composite frame structure with the exception of the end components 42 and 44. The infeed conveyor 12 is disposed along the infeed side of the apparatus, and the support element 22 (FIG. 2) is welded or otherwise fixedly secured to the frame structure 40.

Figure 10:
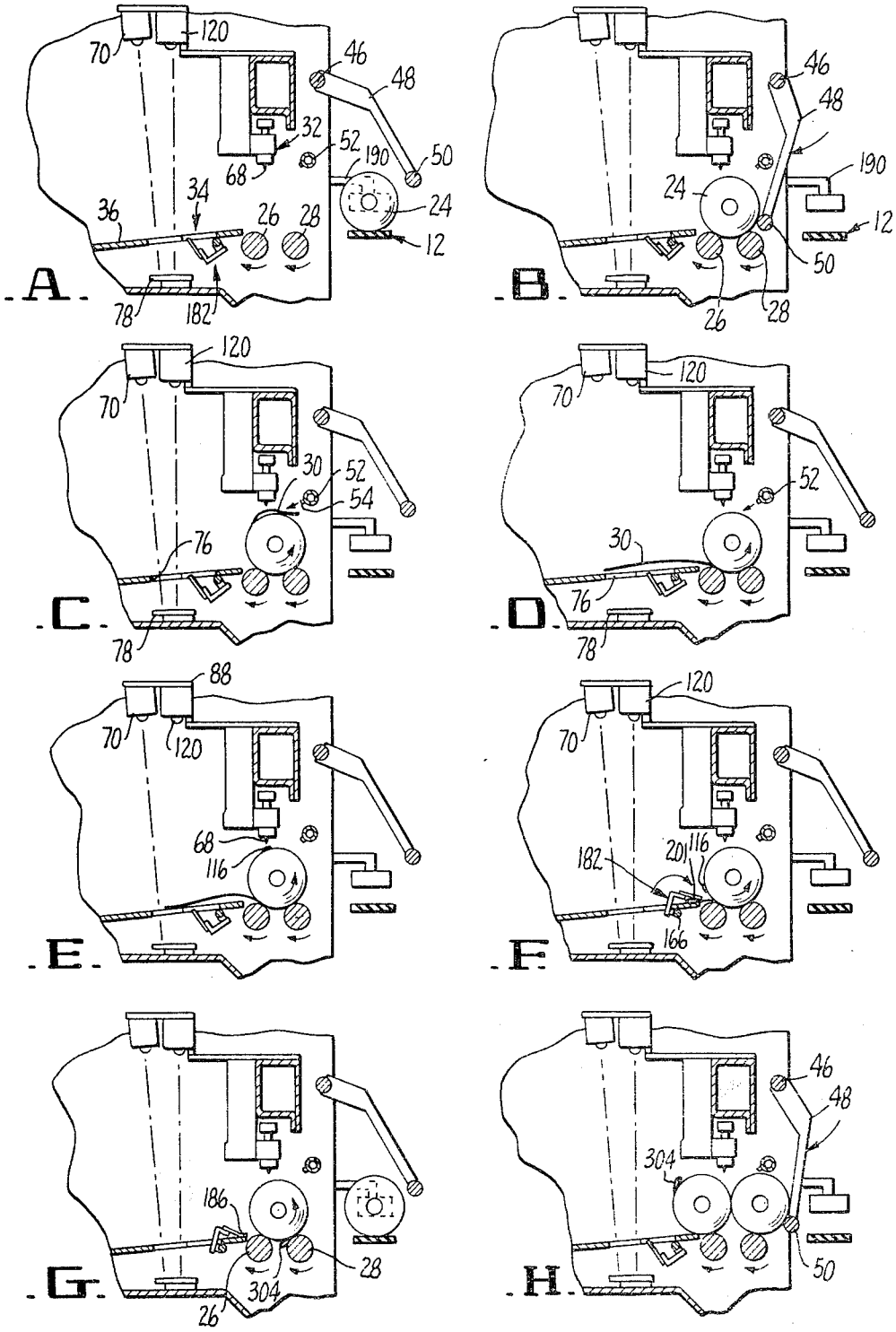
FIG. 10A–10H are diagrammatic views respectively illustrating successive operations in a complete functional cycle of the apparatus.
Figure 11:
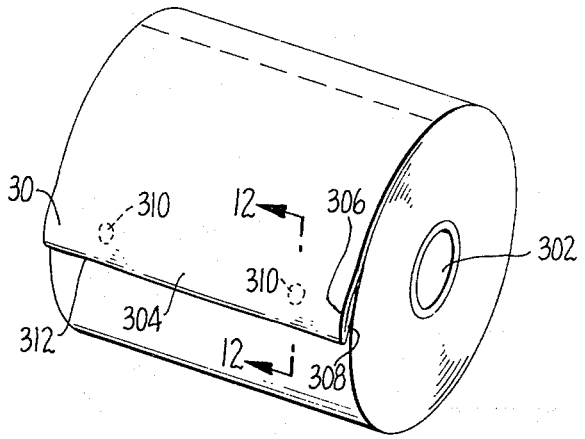
FIG. 11 is a perspective view illustrating an individual roll product of toilet tissue constructed in accordance with the teachings of the present invention.
Figure 12:
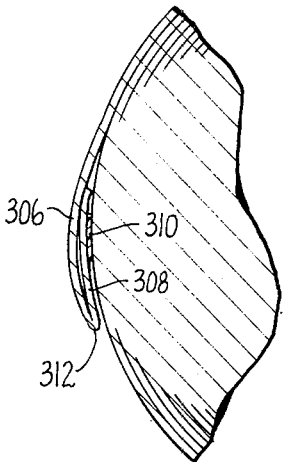
FIG. 12 is an enlarged view taken along the line 12—12 of FIG. 11 showing details of the folded tail portion secured to the underlying roll product convolution.

With particular reference to FIGS. 1 through 4, it may be seen that extending between the end components 42 and 44 and journaled for rotation with respect thereto at an elevation substantially above the infeed conveyor 12 and in spaced relation thereto is a rod or shaft 46 equipped at longitudinally spaced locations therealong with a plurality of pusher arms 48 which are constrained upon the shaft (such as by means of clamp collars) so as to rotate therewith and to be prevented from axial displacements relative thereto. The pusher arms project outwardly and downwardly from the shaft 46, and at their lower outer ends they are connected together by a pusher bar 50. As shown in FIGS. 2 and 10A, the pusher bar 50 in one position thereof is located a spaced distance above and outwardly from the conveyor 12 and any cant 24 supported thereon, and such location of the bar may be considered to represent the cant infeed position thereof.

However, the pusher assembly defined by the shaft 46, arms 48, and bar 50 is adapted to be rotated or displaced angularly in a clockwise direction (as viewed in FIGS. 2 and 10A) from the infeed position shown in these Figures into the position shown in FIG. 10B wherein the pusher bar 50 has traversed an arcuate path of the order of 45° and is disposed inwardly of the conveyor 12. The function performed by the pusher assembly in traversing such arcuate path is to displace a cant 24 from the infeed conveyor 12 and into the operating station wherein it is supported upon the shafts 26 and 28. Following such displacement of a cant into the operation station, the pusher assembly is returned to its initial cant-infeed position shown in FIG. 10C preparatory to the next successive cant being delivered to the apparatus by the infeed conveyor 12 for displacement by the pusher assembly from the infeed conveyor and into the operating station. Angular reciprocal displacement of the pusher assembly may be effected by any suitable drive mechanism, for example, the drive mechanism associated with a similar pusher assembly disclosed in the aforementioned copending application Ser. No. 194,159, filed Nov. 1, 1971. A drive mechanism of this type is indicated generally by reference numeral 56 in FIG. 4.

The rollers or shafts 26 and 28 are operated by means of any suitable driving mechanism 58 (FIG. 5) in a clockwise direction as viewed in FIGS. 10A through 10H. Thus, any cant 24 supported thereby is continuously rotated in a counterclockwise direction as illustrated by means of the arrows in FIGS. 10C through 10G.

After cant 24 has been positioned on shafts 26 and 28 and is rotated thereby the tail or free end portion 30 of the cant is unwound therefrom prior to the application of an adhesive to the cant and formation of the fold tail portion prior to securing same with said adhesive. Such unwinding is accomplished by tail accelerating means located at the operating station of the apparatus which positions the tail portion on the upper flat support surface of inclined chute or platform 36 with the free end of the tail portion spaced from the remaining wound portion of the roll product.

In more particular terms, the unwinding is accomplished by air under pressure being directed toward the tail portion 30 from a gaseous discharge means which in the illustrated embodiment comprises a single nozzle structure 52 extending along the cant generally from end to end of the apparatus as best shown in FIG. 1. The nozzle structure is fixedly located and as illustrated is in the form of an elongated hollow tubular manifold provided therealong with a plurality of longitudinally spaced apertures 54 as may be seen most clearly with reference to FIGS. 2 and 4. Apertures 54 are inclined with respect to a horizontal plane at an angle of the general order of 45° so as to face downwardly and inwardly from a position slightly below the shaft 46 and inwardly thereof. The elongated nozzle structure 52 is connected through a conduit (not shown) with a source of compressed air. Communication may be established between the source of compressed air and the nozzle structure by either a manually operable valve or preferably an automatically controlled valve of the type illustrated in aforementioned copending application Ser. No. 194,159.

Referring now to FIGS. 10C and 10D, it will be seen that compressed air is supplied to nozzle structure 52 as cant or roll product 24 is being rotated counterclockwise (as shown in these figures). The compressed air passes through the longitudinally spaced apertures 54 toward the cant 24 at an angular inclination such that when the tail portion 30 is rotated into operative association with the air blast, it is unwound from the cant and extended along the platform 36 in substantially planar relationship therewith with the outermost extremity or free end of the tail portion being spaced from the wound portion of the roll product remaining supported by shafts 26 and 28. The supply of air to the nozzle structure 52 is then terminated either manually or preferably automatically as taught in application Ser. No. 194,159 until a subsequent cycle of operation where the above-described function is repeated when the next successive cant is delivered from the infeed conveyor 12 to the operating station. In operation, the gaseous discharge from the nozzle structure 52 passes over the cant tending first to lift the tail portion 30 therefrom by negative pressure (as indicated in FIG. 10C) and then to enter the space intermediate the tail portion and subjacent convolution to accelerate the tail by application thereto of a positive gaseous pressure force.

Adhesive is applied to the roll product or cant 24 at a predetermined time in each cycle of operation of apparatus 10. In the illustrated embodiment, as shown in FIG. 10E, a measured quantity of liquid adhesive is discharged directly onto the cant after the tail portion thereof has been positioned with the free end thereof spaced from the wound cant portion as previously described. In accordance with the teachings of the present invention the adhesive could be alternatively applied directly to the tail portion; however, applying it to the wound portion of the cant itself is preferred. The adhesive employed is preferably a water-soluble adhesive so that rejected cants and rolls formed by subdividing same can be recycled through conventional papermaking processes without the necessity of removing the adhesive prior to recycling. The particular apparatus being considered has been found to function in an exceedingly satisfactory manner using a hot melt adhesive in the form of a water-soluble wax applied at a temperature of from approximately 160° to 170°F.

Figure 4:
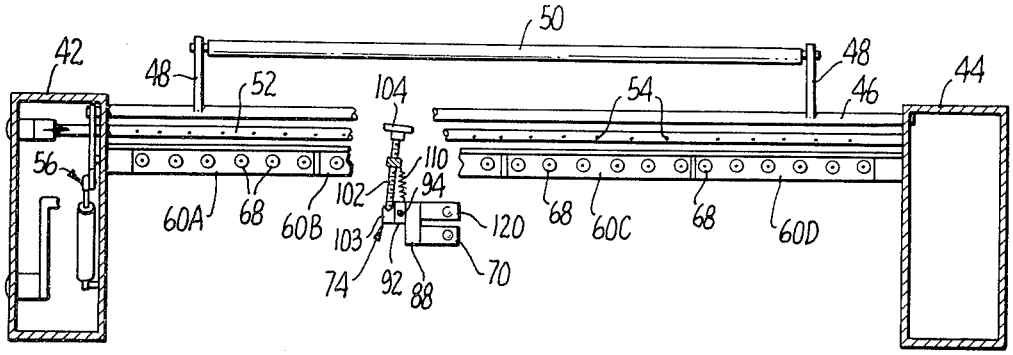
FIG. 4 is a longitudinal sectional view, partially broken away, taken along the line 4—4 of the FIG. 3.

The structure utilized to apply adhesive to cant 24 is located at the operating station of apparatus 10 and, as is most evident in FIGS. 1, 2 and 4, it comprises a plurality of separate adhesive applicator units or modules respectively denoted with the numerals 60A through 60D, there being four such units in the particular apparatus illustrated. The individual units 60A – 60D may be identical and they are preferably removably mounted so that any particular unit may be removed for servicing without disturbing the other units. The adhesive applicator structure will not be described in detail since it may be of any suitable construction. For purposes of the present invention the adhesive applicator structure may be considered to be identical to that disclosed in detail in the aforementioned U.S. patent application Ser. No. 194,159. To understand the operation of the present invention it is necessary to know only that each adhesive applicator unit 60 comprises an elongated casing 62 of generally rectangular cross section and defining a relatively large reservoir therewithin adapted to receive a quantity of adhesive so as to provide an available supply thereof and a plurality of dispensing nozzles 68 supported by suitable support means in spaced apart relationship and in communication with the casing reservoirs. Upon actuation of the adhesive applicator units, predetermined quantities of adhesive ejected from the various discharge nozzles 68 onto the cant convolution disposed thereunder which is the convolution normally underlying the tail portion 30 when said tail portion is completely wound thereabout.

The mechanism (not shown) for ejecting measured quantities of adhesive through dispensing nozzles 68 is controlled by sensing means responsive to the position of the tail portion 30. In particular, such sensing means comprises a photosensitive detector including, as shown best in FIGS. 2 and 4, a light emitting photoelectric tube or cell 70 supported by adjustable bracket mechanism generally denoted by means of the reference numeral 74 mounted above platform 36. Disposed below platform 36 and in registry with an elongated aperture 76 formed therein is a mirror 78. The photoelectric cell 70 and mirror 78 cooperate to detect the presence or absence of a cant tail portion 30 along the platform 36. By virtue of the alignment between photoelectric cell 70 and mirror 78, a continuous beam of light normally passes therebetween in the well-known manner. When, however, a cant tail portion passes therebetween the beam of light is broken. Mirror 78 is preferably adjustably mounted in any well-known manner so that alignment with photoelectric cell may be maintained even upon movement of said cell as will now be described.

Referring now to FIGS. 1, 2 and 4, adjustable bracket mechanism 74 which is used to support photoelectric cell 70 comprises a 90° bracket 88 to which the housing of photoelectric cell 70 is fixedly attached by any suitable means as by screws or the like. The leg of bracket 88 remote from photoelectric cell 70 is fixedly secured by suitable fasteners to a second plate 92 which is pivotally mounted on a pin 94 affixed to the apparatus framework.

In the particular embodiment of the adjustable bracket mechanism 74 illustrated, pivotal movement of plate 92 and the structure dependent therefrom including photoelectric cell 70 may be effected upon turning of a manually rotatable adjustment shaft 102 to which manually graspable nob element 104 is fixedly secured. Shaft 102 is threaded to engage with internal threads formed in a shaft supporting bracket 106, said shaft supporting bracket 106 being fixedly mounted on the apparatus by a plate 108. The end of shaft 102 remote from the nob element is beveled and engages plate 103 in the vicinity of a generally V-shaped recess formed in said plate generally conforming to the shape of the beveled end of shaft 102. Disposed between plate 92 and bracket 106 and having its ends secured thereto is a helical tension spring 110. Spring 110 continuously biases plate 92 so that said plate will move in a clockwise direction (as viewed in FIG. 4) unless otherwise restrained. Restraint against movement is provided by the cooperation between adjustment shaft 102 and plate 92 and upon rotation of shaft 102 the position of plate 92 and its dependent structure including photoelectric cell 70 may be suitably adjusted.

A second photoelectric cell 120 is also mounted on plates 88 and 92. While first photoelectric cell 70 is operatively associated with the adhesive applicator unit to eject adhesive onto the cant at a predetermined location on the wound portion thereof, second photoelectric cell 120 is operatively associated with structure adapted to form a fold at the end of the cant tail portion.

Figure 5:
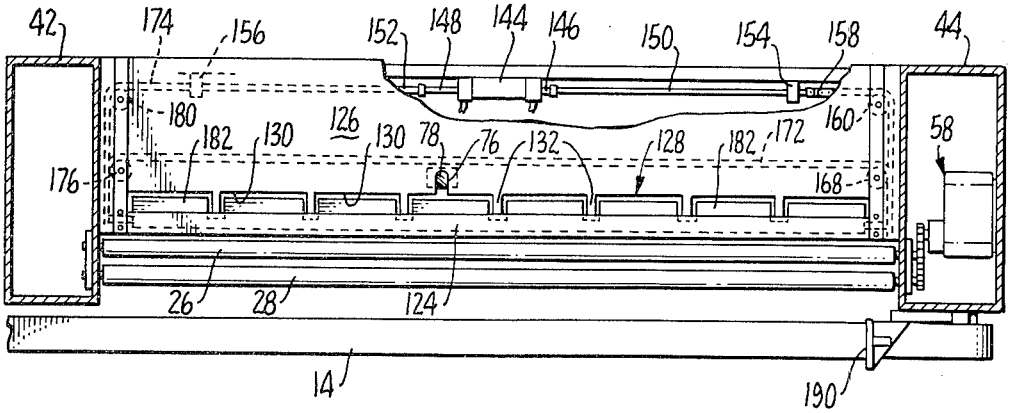
FIG. 5 is a longitudinal sectional view, partially broken away taken along the line 5—5 of FIG. 3.

Referring now to FIGS. 1, 2 and 5, such fold forming structure, which is located in the vicinity of the operating station of apparatus 10, is illustrated in detail. As may be seen in these Figures chute or platform 36 is comprised of two platform segments, a first segment 124 and a second segment 126, both constructed of plate material such as steel plate so as to cooperate in the formation of a substantially flat surface upon which the cant tail end is positioned by the air blast being emitted from nozzle structure 52. The platform segments are spaced from one another to define an elongated opening or aperture 128. Aperture 128 is broken up into individual aperture segments 130 by bridge members 132 which are an integral part of second platform segment 126 which extend into abutting engagement with first platform segment 124 in the manner illustrated. Platform segments 124 and 126 are secured as by means of metal screws to an underlying supporting framework 134 of substantially rectangular configuration and including longitudinal framework elements 136 and side framework elements 140 (FIG.

Figure 7:
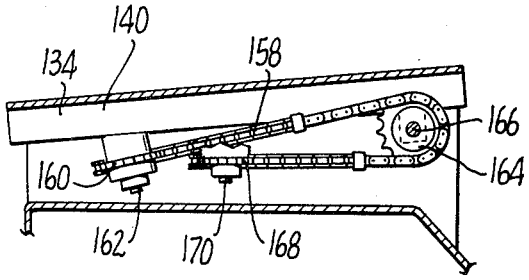
FIG. 7 is an enlarged end view taken along the line 7—7 of FIG. 6.
Figure 6:
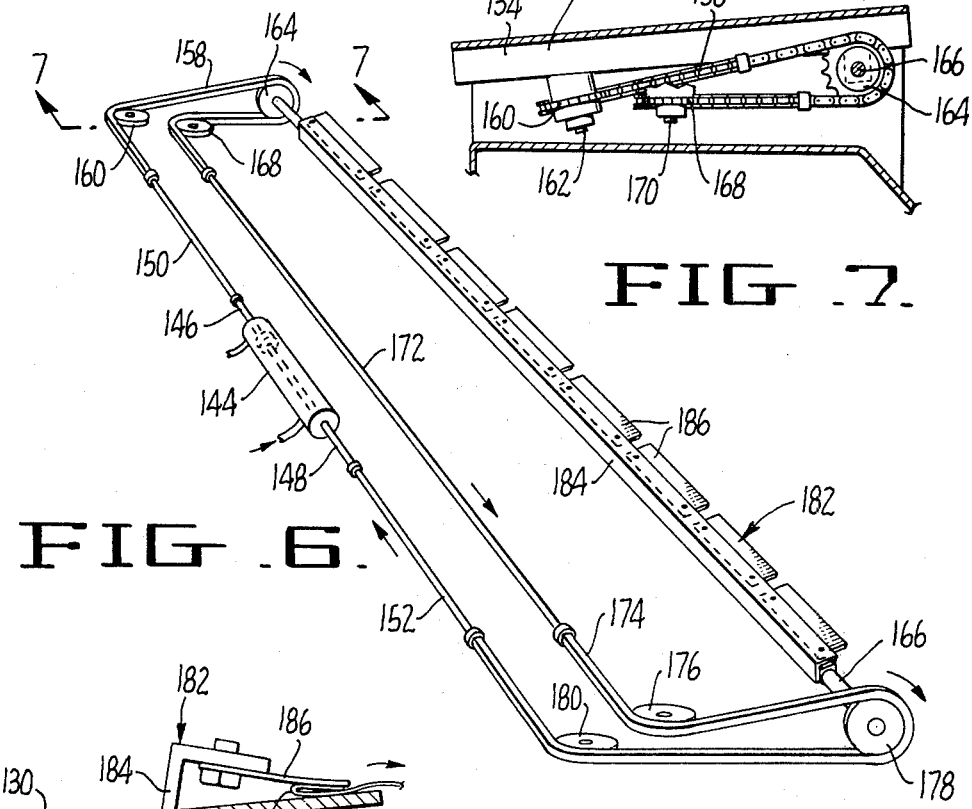
FIG. 6 is a perspective schematic view showing elements of the fold forming mechanism of the apparatus of FIG. 1.

7). Disposed below platform segment 126 and secured to framework 134 is a double-ended pneumatic cylinder 144 having two end rods 146 and 148 (FIGS. 5 and 6). The cylinder 144 is of conventional double-ended construction whereby the end rods are locked for combined movement in either a right or a left direction as viewed in FIG. 5 upon selective pressurization of the cylinder in a well-known manner. Through suitable connecting structure end rod 146 is secured to tie rod 150 and end rod 148 is secured to tie rod 152. Tie rods 150 and 152 are slidably positioned near the outermost extremities thereof within apertures formed in supports 154 and 156, respectively, which are secured to framework element 136 and serve to maintain the tie rods substantially parallel to said framework element. Tie rod 150 at the outermost extent thereof is secured to a length of drive chain 158 which cooperates with and makes a 90° turn about a sprocket wheel 160 (FIGS. 6 and 7) freely rotatably mounted upon a support pin 162 fixedly positioned on supporting framework 134. From sprocket wheel 160 chain 158 proceeds into engagement with a drive sprocket 164 fixedly mounted on a elongated drive shaft 166 which extends the full length of supporting framework 134 and is rotatably mounted with respect thereto in any desired manner. Drive shaft 166 includes an elongated central component having a rectangular cross section and integral end components having circular cross sections upon which the shaft is rotatably journalled. After looping over drive sprocket 164 in the manner illustrated chain 158 engages a sprocket wheel 168 is freely rotatably mounted upon pin 170 depending from side framework 134. The chain then makes another substantially 90° loop and is connected at its end to an elongated tie rod 172 slidably mounted for axial movement with respect to framework 134.

The other end of elongated tie rod 172 is secured to a second length of chain 174. From its point of interconnection with tie rod 172 chain 174 loops about freely rotatably mounted sprocket wheel 176, a second drive sprocket 178 fixedly mounted on elongated drive shaft 166 at the end thereof remote from drive sprocket 164 and then about another freely rotatably mounted sprocket wheel 180. The chain 174 is then connected to reciprocally mounted tie rod 152. It will thus be seen that the end rods 146 and 148 of double-ended pneumatic cylinder 144 are operatively interconnected with elongated drive shaft 166 such that a movement of the end rods to the left (as viewed in FIG. 6) will cause a clockwise rotatable movement of the shaft 166 (as viewed in FIG. 6) while with reference to the same Figure movement of the end rods to the right will result in counterclockwise rotation of the shaft 166. Suitable linkages may be provided in chain lengths 158 and 174 to provide a 90° twist therein to facilitate their turning about the sprockets.

Figure 8:
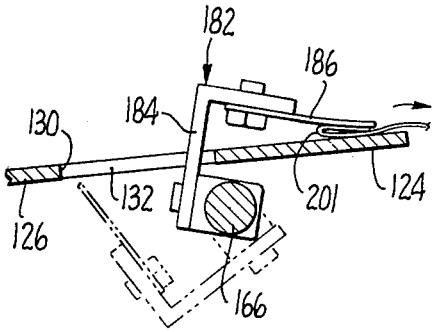
FIG. 8 is an enlarged partially sectional end view showing selected details of the fold forming mechanism.

As may best be seen with reference to FIGS. 6 and 8, elongated drive shaft 166 has mounted thereon a plurality of blade assemblies 182 each blade assembly 182 comprising a 90° angle member 184 having one leg thereof attached directly to the rectangular component of the shaft as by means of threaded fasteners and a blade 186 attached to the other leg of the angle member also as by means of threaded fasteners. Blades 186 are preferably constructed of spring steel or other similar material having some degree of flexibility. Each blade assembly 182 is disposed in registry with an aperture segment 130 and each blade 186 is of a length and width that will permit it to freely pass through the corresponding aperture segment without engaging platform segment 126 or the bridge members 132 defining the sides of the individual aperture segments. Blades 186 are normally disposed below the upper surface of platform 36. When the blades are in this retracted position the end rods 146 and 148 of the pneumatic cylinder 144 are disposed in the position illustrated in FIG. 5. Application of air into the interior of the cylinder to the left of the piston disposed therein will move the end rods in the opposite direction and cause clockwise rotation of shaft 166 as viewed in FIG. 6. This clockwise rotation of shaft 166 results in the blades 186 emerging through aperture segments 130 and such rotation continues until the outermost ends of the blades engage the upper surface of platform segment 124 thus providing a yieldable nip through which the tail portion of the cant shall pass during the fold-forming operation in a manner described in greater detail below.

SUMMARY OF OPERATION

In describing a cycle of operation of the apparatus 10, reference will be made in particular to FIGS. 10A through 10H inclusive, which respectively illustrate various stages of such cycle of operation. In the condition of the apparatus as it is shown in FIG. 10A, a cant 24 has been advanced by infeed conveyor 12 into operative position with respect to apparatus 10. To automatically initiate operation of apparatus 10, such apparatus may include a switch system adapted to energize the apparatus upon positioning of cant 24 in the illustrated position. The switch system may be similar to that utilized in U.S. application Ser. No. 194,159 and include a displaceable arm 190 adapted to be engaged by a cant and displaced thereby to energize apparatus 10 through a suitable switching mechanism. Upon electrical energization of apparatus 10 a motor (not shown) associated with shaft 46 is actuated to cause pivotal movement of pusher bar 50 from the position illustrated in FIG. 10A to the position of FIG. 10B so that cant 24 is displaced to the left by the pusher bar 50 and positioned upon rollers 26 and 28, the drive mechanism 58 associated with the rollers also having been actuated upon energization of apparatus 10 to rotate the rollers in a clockwise direction. Cant 24 upon positioning upon rollers 26 and 28 thus begins to rotate in a counterclockwise direction as illustrated in FIG. 10C. Upon placement of the roll product or cant 24 into position on rollers 26 and 28 shaft 46 reverses direction and pusher bar 50 returns to its initial position as illustrated in FIG. 10C through any suitable mechanism. At about the time the pusher mechanism as embodied by the elements 46 through 50 has returned to the original position thereof, communication is established between nozzle structure 52 and a suitable pressurized air source (not shown) thus causing air to be discharged from apertures 54 in the direction of roll product 24 as it is being rotated. Communciation may be established between nozzle structure 52 and a source of compressed air through any suitable mechanism such as a solenoid controlled valve of the type illustrated for example in U.S. application Ser. No. 194,159. Discharge of air from nozzle structure 52 causes tail portion 30 of cant or roll product 24 to unwind from the cant due to its acceleration under the impact of the compressed air, as shown in FIG. 10C. After the tail portion 30 has be positioned on platform 36 in the manner illustrated in FIG. 10D, a suitable mechanism such as the aforementioned solenoid valve terminates communication between nozzle structure 52 and the compressed air source. It will be noted that when the tail portion 30 of the cant is unwound and is positioned upon platform 36 as shown in FIG. 10D it is disposed over elongated aperture 76 thus interrupting the light path between the photosensitive devices 70 and 120 and the reflecting surface of mirror 78. The solenoid controlled valve or other control device associated with nozzle structure 52 may be operatively associated with the circuitry of one of the photosensitive devices to de-energize same so as to terminate the gaseous discharge from the nozzle apertures 54.

For purposes of the present disclosure adhesive applicator units 60 may be considered to be the same as those employed in the apparatus disclosed in U.S. application Ser. No. 194,159; consequently, the construction and operation of these adhesive applicator units will not be described in detail. Suffice it to say, however, that operation of the adhesive applicator units is controlled by photoelectric cell 70 and upon withdrawal of tail portion 30 from the light path between photoelectric cell 70 and its mirror reflector 78 due to the rotation of roll product 24 by rollers 26 and 28, adhesive applicator units 60 are actuated to cause a measured or predetermined quantity of adhesive 116 to be ejected from each nozzle 68 onto the underlying cant, as illustrated in FIG. 10E.

The next step in the operation of apparatus 10 is illustrated in FIGS. 8 and 10F wherein a fold is formed at the end of tail portion 30 during continued rotation of roll product 24. As The tail portion 30 continues to slied along platform 36 it reestablishes a light path between second photoelectric cell 120 and mirror 78, such light path having previously been interrupted by the initial positioning of the tail portion by nozzle structure 52. Re-establishment of the light path between photosensitive device 120 and mirror 78 results in actuation of the fold-forming means. Specifically, as the tail portion 30 continues to move along platform 36 a solenoid operated air valve (not shown) is opened to establish communication between a source of pressurized air and the interior of double-ended pneumatic cylinder 144 so as to cause the end rods 146 and 148 associated therewith to move to the left as viewed in FIG. 6 thus resulting in rotational movement of drive shaft 166 and passage of blades 186 through aperture segments 130 and into engagement with the upper surface of platform segment 124. The timing of the blade movement is such that the extreme outer end of the tail portion 30 is contacted by the blades 186 so that a bight 201 is formed therein as shown in FIGS. 8 and 10F. Continued rotation of roll product 24 causes the bight to pass through the nip formed between blades 186 and platform segment 124, thus forming a fold 304 along a line extending across the full width of tail portion 30 substantially parallel to the axis of rotation of roll product 24.

As may be seen in FIG. 10F, the fold is formed in close proximity to the rotating wound portion of cant 24 and the integrity of the fold is retained in the brief interval between fold formation and when it is wound into engagement with the rest of cant 24. The formed fold 304 is brought into engagement with an underlying convolution of the cant at the location at which adhesive has been applied thereto. As a consequence, the fold is adhesively secured to the underlying convolution until it is pulled therefrom by the ultimate consumer of the completed roll product.

Figure 9:
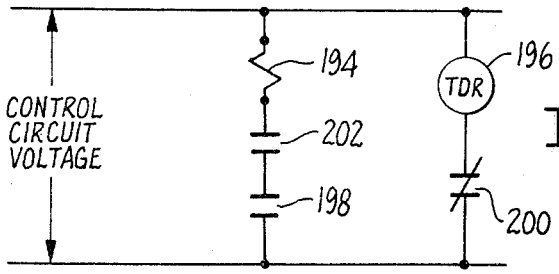
FIG. 9 is a simplified schematic presentation of components of the electrical circuitry used to control the fold forming structure of the present invention.

FIG. 9 is a simplified circuit diagram illustrating operation of the mechanism used to initiate the previously described fold-forming apparatus. Disposed in the circuit is a solenoid valve 194, a time delay relay of the off-delay type 196 and relay contacts 198 and 200 of the previously described second photoelectric cell 120. Upon energization of the apparatus 10, a control circuit voltage is established across the tail folder circuitry as shown. Photoelectric relay contact 198 is closed at this point while relay contact 200 is open. Upon positioning of tail portion 30 upon platform 36 in the manner previously described, the light path between photoelectric cell 120 and mirror 78 is interrupted. This action causes contact 198 to open and contact 200 to close thus actuating time delay relay 196 closing contacts 202 thereof. At this stage of the operation the folding blades 186 still remain in inoperative position. Upon continued movement of tail portion 30 due to its rewinding about cant 24, contacts 198 are again closed and contacts 200 are opened. Since contacts 202 of the time delay relay remained closed and timing, solenoid valve 194 is actuated thus establishing communication between pneumatic cylinder 144 and a source of compressed air. The blades 186 are rotated and a fold is formed in the tail portion as previously described. After a predetermined time delay, contacts 202 are again opened and the folder solenoid valve 194 is de-energized. The operation of the pneumatic cylinder is then such as to return the blades to their inoperative position. The fold-forming circuitry and apparatus is thus returned to its initial condition awaiting actuation by another cant.

After the fold 304 is wound onto the cant continued rotation thereof tends to flatten the fold as it passes between the cant and rollers. Referring to FIG. 10G, a second roll product or cant 24 is shown being displaced inwardly by pusher bar 50 into place on rollers 26 and 28. The cant having an adhesively secured fold previously formed thereon is displaced down the chute by the newly positioned cant. The displaced cant is then removed to a cutting station (not shown) at which the cant is cut into individual segments, e.g. individual rolls of toilet tissue, which are then packaged and sent to their ultimate destination.

Figure 14:
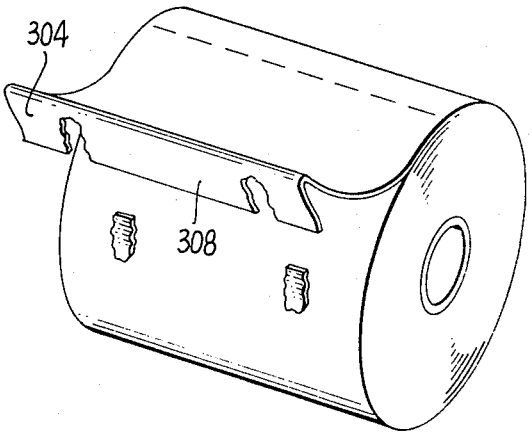
FIG. 14 is a view similar to FIG. 11 but illustrating the tail portion fold after it has been detached from the convolution normally underlying same.
Figure 13:
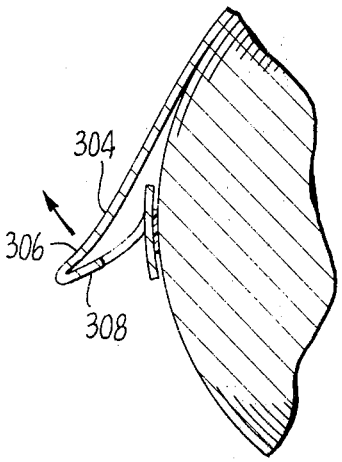
FIG. 13 is a view similar to FIG. 12 illustrating the tail portion fold being detached from the convolution normally underlying same.

FIGS. 11 through 14 illustrate a completed roll product manufactured by the method and apparatus previously described. The roll product illustrated is an individual roll of toilet tissue that has been cut from a log or cant. It will be appreciated, however, that the teachings of the present invention may be applied with respect to a roll product constructed of any suitable material and of any size. Specifically, the illustrated roll product includes an elongated sheet of tissue wound to provide a plurality of convolutions and having a tail portion 30. As is conventional with toilet tissue, the convolutions are formed about an inner core 302 formed of paperboard or the like. A fold 304 is formed in the tail portion. The fold comprises tail portion segments 306 and 308 disposed in substantially parallel relationship with segment 308 terminating with a free end. The fold is in abutting engagement with an underlying convolution of the roll product. Adhesive preferably but not necessarily in the form of dots 310 is spaced along the abutting surfaces of the fold and the underlying convolution thus releasably securing the fold. The fold is adapted for manual grasping by the user of the roll product whereby release of the secured fold and unwinding of the roll product are facilitated. To facilitate insertion of the user's fingers, the adhesive preferably but not necessarily secures the fold to the underlying convolution at a location spaced from a substantially straight fold line 312 which is substantially parallel to the longitudinal axis of the roll product. By making the tail portion segment terminating with a free end the segment of the fold in abutting engagement with the underlying convolution and directly adhesively secured thereto, tearing of the roll product by the user upon initiating the unwinding thereof is reduced. This is because of the fact that in prior art roll products having adhesively secured ends, and in particular paper roll products such as toilet tissue, tears sometimes occur which extend for relatively long distances upon unwinding thereof. In the case of the present roll product, the length of any tear that occurs is limited since any tear that starts in the manually graspable fold necessarily terminates at the free end of the underlying tail portion segment. FIG. 13 shows the fold 304 being pulled away and FIG. 14 shows the relatively short tears that appear in segment 308 upon total removal, thus eliminating waste.

Figure 15:
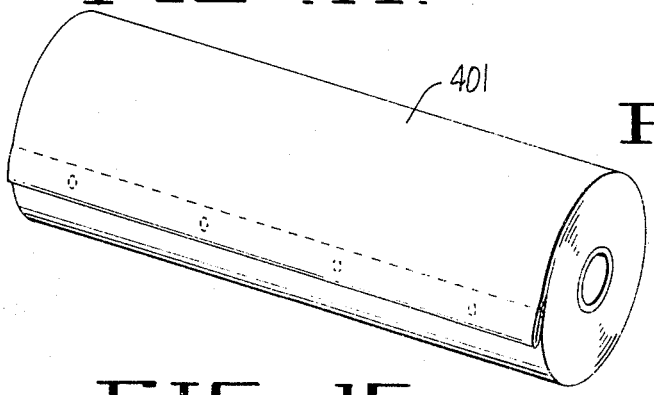
FIG. 15 is a perspective view illustrating a roll product of paper towelling constructed in accordance with the teachings of the present invention.

As previously noted, the present invention is applicable to any types of roll product materials including, but not limited to, paper toilet tissue and toweling, both single and multi-ply. FIG. 15 shows an individual paper towel roll 401 constructed in accordance with the teachings of the present invention. In addition to paper products, the present invention may be utilized with polyethylene or other plastic films, webs made of synthetic pulp, laminates and virtually all other materials which lend themselves to being formed as a roll product.

What is claimed is:

1. In a method of securing the unaffixed tail portion of a roll product to a convolution thereof underlying said tail portion, the steps of:

positioning the tail portion of said roll product so that the free end of said tail portion is spaced from a wound portion of said roll product;

providing a fold at the end of said roll product tail portion along a fold line;

depositing a quantity of adhesive onto said roll product at a predetermined location on said roll product;

winding said tail portion about said wound portion; and securing the fold of said tail portion to the roll product convolution underlying same with said adhesive so that said roll product terminates at said fold line.

2. The method of claim 1 in which the step of positioning the tail portion of said roll includes unwinding the tail portion of said roll product from a wound position on said roll product.

3. The method of claim 1 in which all of the aforesaid steps are performed while said roll product is continuously rotated in a direction tending to wind said tail portion thereabout.

4. The method of claim 1 wherein the adhesive is applied to the underlying convolution of said roll product at a predetermind location adapted to underlie the fold when said tail portion is wound about said wound portion.

5. The method of claim 1 wherein said adhesive is applied in sufficient quantity to maintain the integrity of the fold after it is secured to the underlying convolution.

6. The method of claim 1 wherein the roll product is a multi-ply sheet material.

7. The method of claim 1 wherein the step of providing the fold includes forming a bight in said tail portion and exerting a compressive force on said bight to provide at least two manually graspable tail portion segments disposed in substantially parallel relationship.

8. The method of claim 7 wherein said compressive force is exerted by pulling said bight through a nip.

9. The method of claim 7 wherein one of said manually graspable segments includes the tail portion free end.

10. The method of claim 9 wherein the manually graspable segment including the tail portion free end abuts against the underlying roll product convolution when said tail portion fold is secured thereto.

11. The method of claim 1 wherein the fold is formed so that the fold line is disposed substantially parallel to the longitudinal axis of said roll product with said adhesive securing the fold at a location spaced from said fold line.

12. In a method of securing the unaffixed tail portion of a roll product to a convolution thereof underlying said tail portion, the steps of:

unwinding the tail portion of said roll product therefrom;

depositing a quantity of adhesive onto said roll product while said tail portion is unwound;

forming a fold at the end of said tail portion along a fold line;

rewinding said tail portion onto the remainder of said roll product so that said adhesive is positioned between said fold and said underlying convolution; and exerting a compressive force on said fold to press same into engagement with said underlying convolution to adhesively secure the fold to the underlying convolution so that said roll product terminates at said fold line.

13. The method of claim 12 in which all of the aforesaid steps are performed while said roll product is continuously rotated in a direction tending to wind said tail portion thereabout.

14. The method of claim 13 in which said compressive force is applied periodically to said fold during continued rotation of said roll.

15. A roll product comprising:

an elongated sheet of flexible material wound to provide a plurality of convolutions and having a tail portion;

a fold formed at the end of said tail portion, said fold comprising at least two tail portion segments connected along a fold line and disposed in substantially parallel relationship with one of said segments terminating with a free end, said fold being in abutting engagement with an underlying convolution of said sheet material and said roll product terminating at said fold line; and means releasably securing said fold to said underlying convolution, said releasably secured fold being adapted for manual grasping by the user of the roll product whereby release of said secured fold and unwinding of said roll product are facilitated.

16. The roll product of claim 15 wherein said material is single ply paper.

17. The roll product of claim 15 wherein said material is multi-ply paper.

18. The roll product of claim 15 wherein said securing means comprises adhesive in the form of discrete dots spaced along the abutting surfaces of said fold and said underlying convolution.

19. The roll product of claim 15 wherein said segment terminating with a free end is in abutting engagement with said underlying convolution and said securing means comprises adhesive directly securing the segment terminating with a free end to the underlying convolution.

20. The roll product of claim 15 wherein said segments are folded about a substantially straight fold line extending across said roll product, said securing means securing said fold to said underlying convolution at a location spaced from said fold line.

21. The roll product of claim 20 wherein said fold line is substantially parallel to the longitudinal axis of said roll product.

* * * * *